United States Patent [19]

Hamilton

[11] Patent Number: 4,601,352

[45] Date of Patent: Jul. 22, 1986

[54] AUTOMATIC COMPACTOR

[75] Inventor: Edward R. Hamilton, Austin, Tex.

[73] Assignee: Rainhart Company, Austin, Tex.

[21] Appl. No.: 652,045

[22] Filed: Sep. 19, 1984

[51] Int. Cl.[4] ..... B30B 9/38

[52] U.S. Cl. ..... 173/124; 173/122; 173/31; 474/115

[58] Field of Search ..... 173/122, 124, 31, 19; 464/49; 474/115, 117

[56] References Cited

U.S. PATENT DOCUMENTS

| | | | |
|---|---|---|---|
| 1,419,156 | 6/1972 | Leyner | 474/116 |
| 1,677,422 | 7/1928 | Abram . | |
| 2,378,131 | 6/1945 | Dirksen et al. . | |
| 2,447,586 | 8/1948 | Marshall . | |
| 2,471,227 | 5/1949 | Marshall . | |
| 3,010,665 | 11/1961 | Smith . | |
| 3,108,503 | 10/1963 | Murek . | |
| 3,205,952 | 9/1965 | Sicotte . | |
| 3,543,868 | 12/1970 | Drake . | |
| 3,566,668 | 3/1971 | Browning et al. . | |
| 3,986,566 | 10/1976 | Hamilton . | |
| 4,069,911 | 1/1978 | Ray | 474/156 X |

FOREIGN PATENT DOCUMENTS 568752 4/1945 United Kingdom .

*Primary Examiner*—E. R Kazenske
*Assistant Examiner*—Willmon Fridie, Jr.
*Attorney, Agent, or Firm*—Jones, Tullar & Cooper

[57] ABSTRACT

An automatic compaction assembly for compacting samples of asphaltic or bituminous materials is disclosed. A slide hammer is carried for vertical motion along a guide rod which has a compaction foot at a lower end. A drive chain is driven along a generally triangular path by a suitable drive motor and has weight engaging and raising lugs. An upper chain sprocket shuttle and a lower chain sprocket shuttle are slideably carried in a main frame of the compactor and cooperate with a drive sprocket on the drive motor to define the triangular path of chain travel. A horizontal overarm is formed as a portion of the upper shuttle and receives the upper end of the guide rod. As the guide rod moves downwardly, the release point defined by the upper shuttle also moves down thereby maintaining a constant weight drop distance during sample compaction. The slide weight, after being released from the drive chain continues to move upwardly along the guide rod until its upward travel is halted by gravity. A true free fall of the weight is thus maintained thereby satisfying testing requirements.

14 Claims, 5 Drawing Figures

AUTOMATIC COMPACTOR

FIELD OF THE INVENTION

The present invention is directed generally to an automatic compactor. More particularly, the present invention is directed to an automatic compactor for compacting laboratory specimens of asphaltic material. Most specifically, the present invention is directed to an automatic compactor having a constant height of drop for a free falling sliding hammer. The free falling sliding hammer travels vertically downwardly along a guide rod and strikes a compacting foot carried at the lower end of the guide rod. The sliding hammer is repeatedly raised and released by an endless drive chain that travels in a generally triangular path. The height of drop of the sliding hammer is held constant during compaction of the sample under test through the use of upper and lower chain sprocket support shuttles that are vertically slideable in the main frame of the automatic compactor. As the compaction foot is driven down by the slide hammer, the upper chain sprocket, which controls the release height for the slide hammer, also moves downwardly thereby maintaining a constant height of drop for accurate sample compaction testing.

DESCRIPTION OF THE PRIOR ART

Various compaction devices for use in the compaction of samples of asphaltic and bituminous materials used as road paving materials are generally well known in the art. An example of such a compaction apparatus may be seen in my prior U.S. Pat. No. 3,986,566 issued Oct. 19, 1976 and assigned to a common assignee. These compaction assemblies are used to perform a test procedure for paving materials, known generally in the art as the "Marshall Method" and described in ASTM Designation D1559.

The Marshall Method procedure requires that the sample being tested be subjected to 50 blows delivered by a 10 pound hammer falling through a distance of 18 inches. In the several compaction assemblies commercially available, this weight is repeatedly raised by, and released from an endless chain. In my prior patent as well as in the several other compaction assemblies such as the one set forth in Marshall's U.S. Pat. No. 2,447,586, the sliding weight is equipped with fingers that are engaged by one or more of the chain links, usually by lugs that extend from the middle or sides of the chain. Various release mechanisms are employed in the prior art devices to release the slide hammer once the chain has raised it to the desired height so that the hammer can slide down the guide rod to strike the compaction foot. Since the guide rod is attached to the compaction foot, the height of drop is independant of the height of the speciman under test.

The several automatic compacting assemblies currently on the market, including my prior patented device, utilize a slide hammer release mechanism that is carried on the slide hammer guide rod. Since the height of drop must remain constant to satisfy test procedure requirements, and further since the guide rod moves downwardly during sample compaction, the prior art automatic compactors have relied on release mechanisms positioned on the guide rod so that a constant drop height can be maintained.

While the compaction apparatus disclosed in my prior patent has been a commerical success, several areas have been found which can be improved to provide a better assembly. One of these areas is that of tamping speed. While the prior apparatus operates at a speed of approximately 52 blows a minute, it would be desirable to increase this speed thereby minimizing sample compaction time and hence sample temperature drop during compaction. Since compactability is temperature sensitive, this reduction in compaction time and hence temperature change will promote more accurate testing. However, this tamping speed has been, to some extent, limited by the time required for the release assembly carried at the top of the guide rod to disengage the slide hammer from the drive chain. Attempts to increase tamping speed by increasing drive chain speeds have resulted in release mechanism jams and equipment failures.

The release mechanisms utilized in prior art devices have required the hammer to contact some type of assembly which has either dissipated or added to the hammer's energy. While the ASTM procedure specifies a free-falling body, the compaction assemblies presently available do not fully satisfy this requirement. Additionally, the release mechanisms in accordance with the prior art devices have, in the case of my prior patented device, utilized a pivoted guide rod and a spring assembly. The unique pivoting of the guide rod to effect release of the slide hammer has not been universally accepted. Finally, the self-destructive forces generated by a 10 pound weight falling through 18 inches to strike a heavy metal compaction foot at a rate of 50 cycles per minute are, as can be well imagined, quite substantial. Accordingly, there has been expressed a need for an automatic compaction apparatus that is uncomplicated, rugged, easy to use, and which will stand up well to the self-destructive forces to which it is continually subjected.

SUMMARY OF THE INVENTION

It is an object of the present invention to provide an improved automatic compaction apparatus.

Another object of the present invention is to provide an automatic compaction apparatus having a constant height of drop.

A further object of the present invention is to provide a compaction apparatus which utilizes a slide hammer release mechanism independent of the guide rod.

Yet another object of the present invention is to provide an automatic compaction assembly having an increased tamping speed.

Still a further object of the present invention is to provide an automatic compaction apparatus whose chain tension is constant.

Still yet another object of the present invention is to provide an automatic compaction assembly that is rugged, durable, and will tolerate the abuse to which it is subjected.

As will be discussed in greater detail in the description of the preferred embodiment, which is set forth hereinafter, the automatic compaction assembly for compacting laboratory specimens of asphaltic or bituminous materials in accordance with the present invention, is comprised generally of a main support frame, a generally conventional slide hammer and compaction foot, a pair of slideable chain sprocket support shuttles which cooperate with the chain drive sprocket to define a generally triangular path for the drive chain, and means to adjust the shuttle positions in response to chain speed and tension to thereby maintain a constant height of drop.

In devices wherein the height of drop is not critical, as exemplified by U.S. Pat. No. 1,677,422 to Abrams, release of the hammer is accomplished by pulling the chain lugs away from the weight support fingers as the direction of travel of the chain is altered as it passes over the upper fixed guide sprocket. Such a release procedure, which requires no release mechanism, has previously not been usable in situations where height of drop was critical, as it is in asphalt testing. However, the automatic compactor in accordance with the present invention can utilize this uncomplicated release principle due to its unique structure, as will be detailed shortly, and hence attains the several desired results alluded to previously.

Tamping rates can be increased to approximately 80 blows per minute since there is no complex release assembly to dictate lower chain speeds. Now the tamping rate is a function more of the time required for the hammer to fall 18 inches than of the maximum chain speed which would not overwhelm the release mechanisms of the prior art drives. Since tamping speeds can be increased, test results are more satisfactory.

The height of drop can be kept constant regardless of chain speed or the changing release point caused by downward movement of the guide rod as the sample is compacted. This is accomplished by maintaining the vertical spacing between the upper chain sprocket and the upper end of the guide rod constant during compaction. This spacing does not change because the upper sprocket moves with the downward movement of the guide rod so the height of drop remains constant. Further, since this vertical spacing can be preset and can be varied depending on chain speed, the height of drop can be precisely set prior to test use and can be checked periodically during the test usage.

The compactor assembly in accordance with the present invention essentially contains no moving parts other than the drive chain and motor. There is no pivoted guide rod, no complex release mechanism, no return spring assembly and hence virtually nothing which will break or become disabled under the continuous pounding which the assembly is subjected to. The automatic compactor in accordance with the present invention is durable, reliable, requires little maintenance, and stands up to the self-destructive forces which it generates.

BRIEF DESCRIPTION OF THE DRAWINGS

While the novel features of the automatic compactor in accordance with the present invention are set forth with particularity in the appended claims, a full and complete understanding of the invention may be had by referring to the detailed description of the preferred embodiment as set forth hereinafter, and as may be seen in the accommpanying drawings in which:

DESCRIPTION OF THE PREFERRED EMBODIMENT

Figure 1:
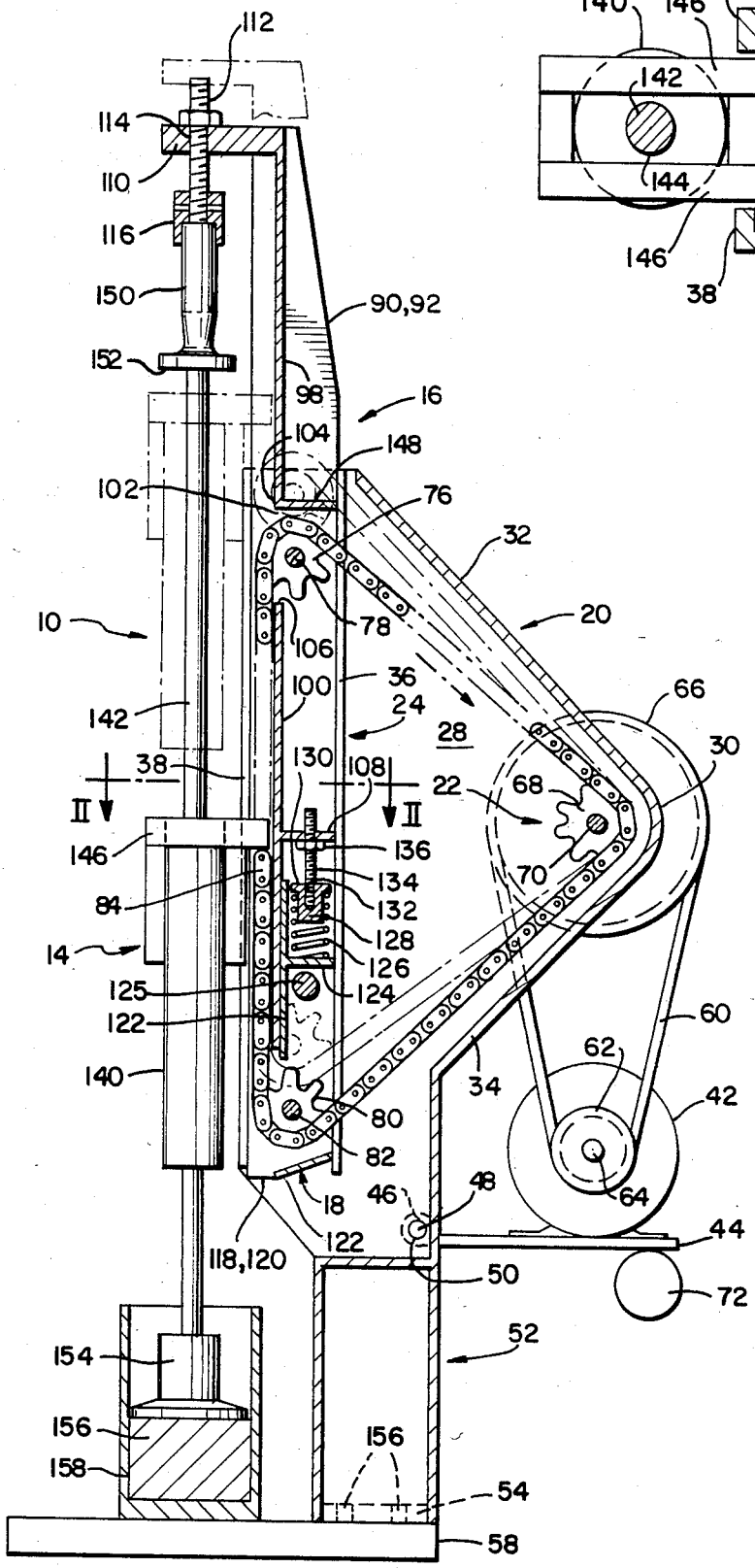
FIG. 1 is a side elevation view, partly in section, of the automatic compactor in accordance with the present invention.

Referring initially to FIG. 1, there may be seen generally at 10 a preferred embodiment of an automatic compactor for asphaltic and bituminous samples in accordance with the present invention. Automatic compactor is comprised generally of a slide hammer, compaction foot and guide rod assembly 14, an upper chain sprocket shuttle 16, a lower chain sprocket shuttle 18, a frame assembly 20 which slideably carries upper and lower shuttles 16 and 18, and a drive motor and drive chain assembly 22. In an operational overview, the drive motor and chain assembly 22 lifts a slide hammer or drop weight along the guide rod portion of the hammer, rod, and compaction front assembly 14. The weight is released from the chain and is thrown upwardly until it comes to rest. It then free falls to compact the sample being tested. As the compaction foot and hence the guide rod moves downwardly during sample compaction, the upper and lower chain sprocket support shuttles, generally at 16 and 18, slide downwardly within the main frame assembly 20 so that the point of release of the slide hammer with respect to the compaction foot always stays constant.

Figure 2:
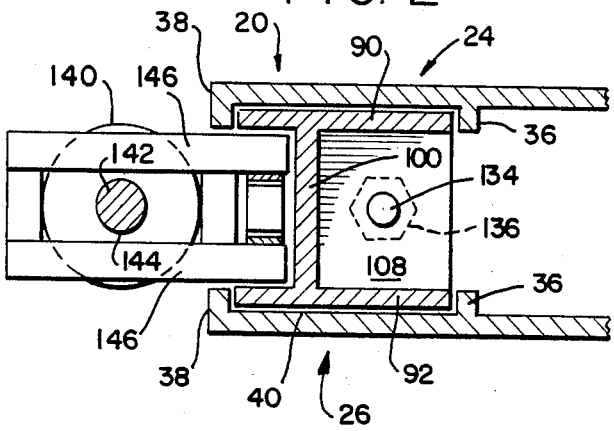
FIG. 2 is a cross sectional view taken along line II—II of FIG. 1.
Figure 3:
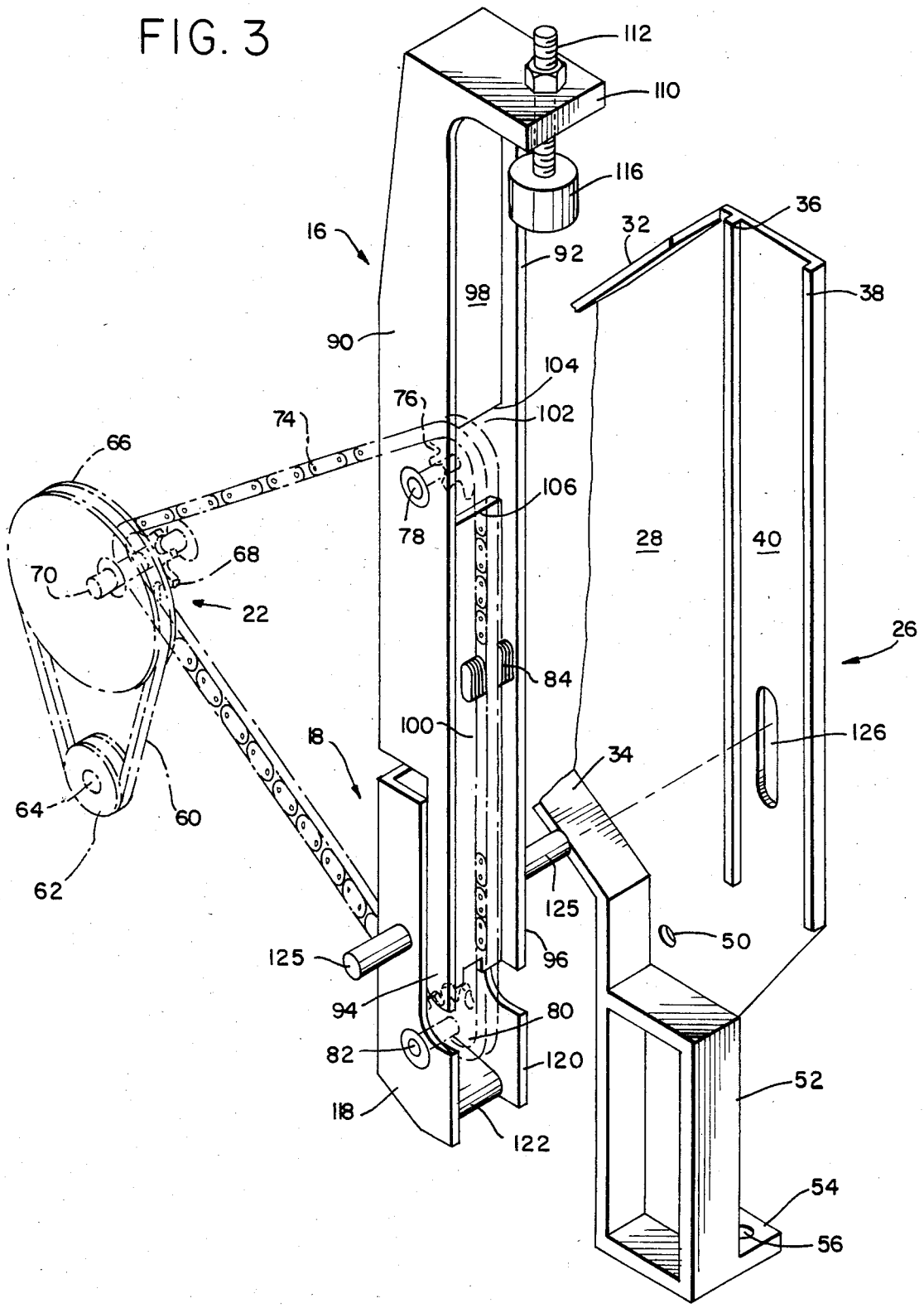
FIG. 3 is an exploded front perspective view of the upper and lower chain sprocket shuttles and one portion of the frame of the automatic compactor.

Referring now to FIGS. 1, 2, and 3 main frame assembly, generally at 20, is comprised of a pair of opposed frame sections 24 and 26 with frame section 24 being seen in FIG. 1 and section 26 being seen in FIG. 3. It will be understood that these two sections are essentially mirror images of each other so that a description of one applies also to the other. As shown in FIGS. 1 and 3, each frame section 24 and 26 includes a generally triangular shaped, vertically oriented frame plate 28 whose apex 30 is toward the rear of the compactor 10. Frame plate 28 has inwardly extending upper and lower cover flanges 32 and 34, as seen in FIG. 3, extending along the sides of the triangle. A pair of spaced, vertical, inwardly, extending guide ribs 36 and 38 are positioned at the forward end or base of the triangular frame plate 28. These guide ribs 36, 38 define a guide channel 40 within which the upper chain sprocket support shuttle 16 and the lower chain sprocket support shuttle 18 are slideably carried, as may be seen in FIG. 1, and as will be discussed in greater detail subsequently.

A drive motor 42 is supported on a horizontal motor support plate 44 which is pivotably supported at an inboard end 46 by a pin 48 that passes through an aperture 50 in frame plate 28. Aperture 50 is placed just above a generally rectangular support base 52 for the frame plate 28. Support base 52 includes an outwardly extending support foot 54 which has spaced bolt holes 56 through which suitable bolts or the like (not shown) can be passed to secure the two main frame halves 24 and 26 to a support platform 58 or the like, thereby securely suporting the main frame 20 and drive motor 42.

A V-belt 60 or other similar flexible drive belt, passes between a small drive pulley 62, carried by drive shaft 64 of motor 42, and a larger driven pulley 66. Driven pulley 66 drives a chain drive sprocket 68 on a drive sprocket shaft 70 which is journaled between the apexes 30 of the triangular frame plates 28. Tension is imparted to drive belt 60 to prevent its slippage in pulleys 62 and 66 by the downward force exerted by the weight of drive motor 42 supported on pivotable platform 44. If needed, extra weights 72 can be attached to the motor support plate or platform 44 to increase the tension in drive belt 60.

Figure 5:
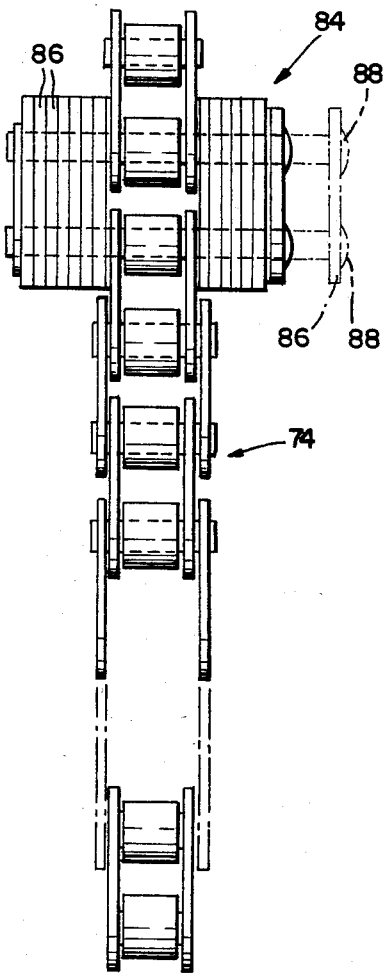
FIG. 5 is a front view of the drive chain assembly showing the lifting lugs attached to the chain.

A drive chain 74 travels in a generally triangular path defined by drive sprocket 70, an upper driven chain sprocket 76 carried on an upper sprocket shaft 78 journaled in upper chain sprocket shuttle generally at 16, and a lower driven chain sprocket 80 carried on a lower sprocket shaft 82 journaled in lower chain sprocket shuttle, generally at 18. Drive chain 74 is a generally conventional roller chain, as seen in FIG. 5 with the addition of a pair of opposed, outwardly extending pickup lugs 84. These lugs are formed by attaching a plurality of chain side plates 86 together on elongated link pins 88. These pickup lugs 84 engage the slide hammer and elevate it as the chain is driven by motor 42.

Figure 4:
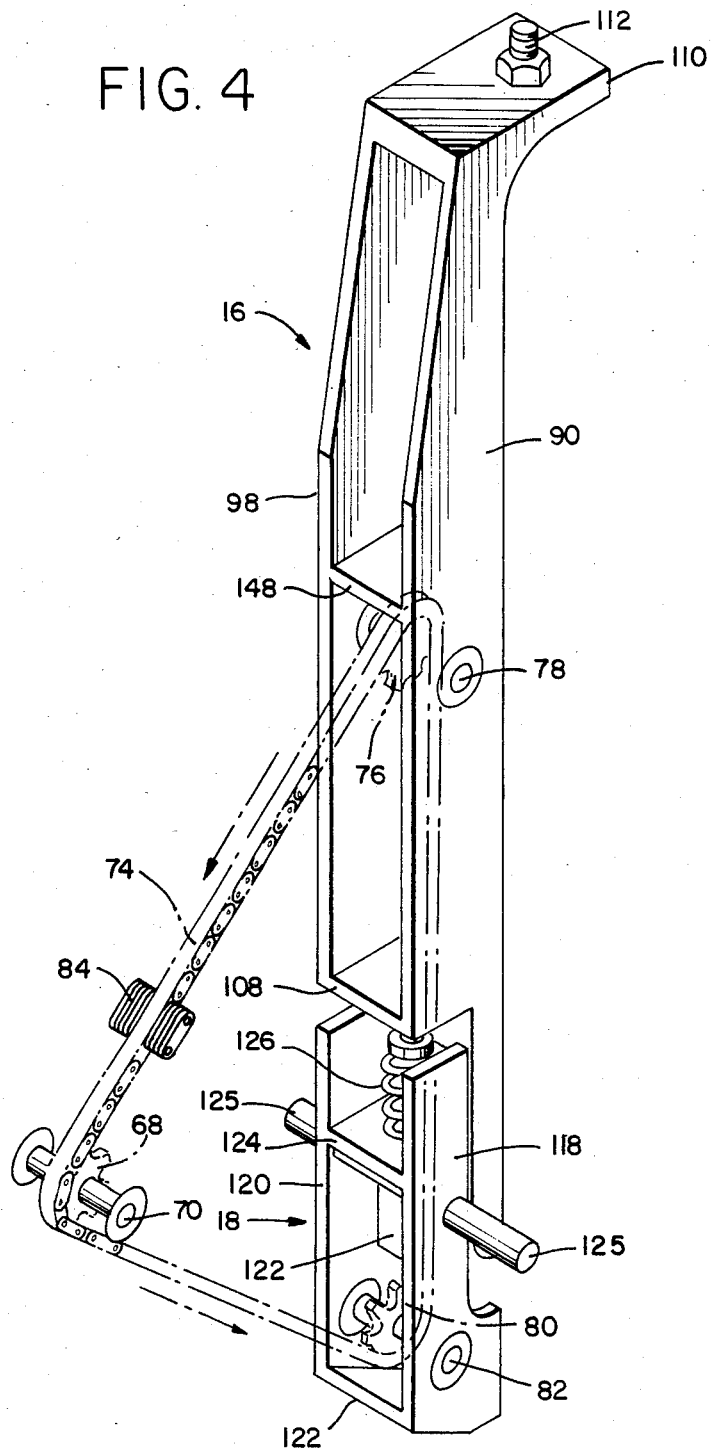
FIG. 4 is a rear perspective view of the upper and lower chain sprocket shuttles.

Turning now to FIGS. 1, 3, and 4 the structure and cooperation of the upper and lower chain sprocket support shuttles, generally at 16 and 18, will now be discussed in greater detail. Upper shuttle 16 is generally in the shape of an inverted L and is comprised of spaced side plates 90 and 92 whose lower portions 94 and 96 are of reduced width. An upper web 98 and a lower web 100 extend between the side plates 90 and 92, generally adjacent the forward portions of side plates 90 and 92. A chain passage port 102 is formed between the lower end 104 of upper web 98 and the upper end 106 of lower web 100. Upper driven chain sprocket 76 is positioned within this chain passage port 102. An upper horizontal platform 108 is provided between side plates 90 and 92 of the upper shuttle 16 at the point of reduced plate width. A horizontal overarm 110 forms the generally horizontal portion of the L-shaped upper shuttle 16. Overarm 110 carries a threaded rod 112 which passes through a threaded bore 114 and which carries a cup socket 116 on its lower end. Cup socket 116 engages an upper end of the guide rod.

Lower chain support shuttle, generally at 18, also is comprised of spaced side plates 118 and 120 that are joined by a front web 122 which is located behind lower web 100 of upper shuttle 16, as seen in FIG. 1, when the two shuttles 16 and 18 are in operative position. Lower driven chain sprocket 80 and its shaft 82 are carried generally at the lower end of lower shuttle 18 whose lowest end is provided with a chain guide plate 122. A lower horizontal platform 124 extends between the side plates 118 and 120 of lower shuttle 18. A pair of handles 125 are attached to side plates 118 and 120 and extend outwardly through elongated apertures 126 in the guide channels 40 of frame sections 24 and 26. Upper shuttle 16 and lower shuttle 18, which are slideably supported in guide channels 40 and limited in forward and rearward motion by guide ribs 36 and 38, can be raised or lowered in the guide channels 40 by use of handles 125.

A drive chain tensioning spring 126 is, as may be seen in FIGS. 1 and 4, supported at its lower end by lower horizontal support platform 124 on lower shuttle 18. A generally cylindrical plug 128 is received in the open upper end of spring 126 and is prevented from passing through spring 120 by an upper, circular, radially outwardly extending lip 130. A threaded hole 132 is provided in plug 128 and receives a first, lower end of a threaded rod 134 whose second, upper end is received in a threaded bore in upper horizontal platform 108 in upper shuttle 16. A locking nut 136 is attached to rod 134 below upper platform 108. Thus upper shuttle 16 and lower shuttle 18 are forced apart by spring 126 yet are held together by drive chain 74 passing about upper driven chain sprocket 76, lower chain sprocket 80 and drive sprocket 68. It will be understood that the tension on the drive chain can by adjusted by changing the compression of spring 126 through suitable tightening or loosening of rod 134 and nut 136. Upper shuttle 16 and lower shuttle 18 move as a unit generally vertically along the guide channels 40 in frame sections 24 and 26.

Turning again to FIG. 1, a slide hammer or sliding weight 140 is slideable vertically along a guide rod 142. In the preferred embodiment, slide hammer 140 is generally cylindrical and guide rod 142 passes through an axial bore 144 in the weight 140. A pair of spaced, rearwardly extending arms 146 are secured to the upper portion of slide hammer 140 and these arms are engaged by pickup lugs 84 on drive chain 74 to raise slide hammer 140 as drive chain 74 is driven in a generally clockwise direction along the triangular path defined by drive sprocket 68, upper driven sprocket 76, and lower driven sprocket 80, as seen in FIG. 1. Pickup lugs 84 are held within their desired path as they raise slide hammer 140 by, as may be seen in FIGS. 1 and 3, the cooperation of side plates 90 and 92 of upper shuttle 16 and by lower web 100 also of upper shuttle 16. These combine to define a channel within which drive chain 74 and pickup lugs 84 move. Lower chain guide plate 122 on lower shuttle 18 and a similar upper chain guide plate 148 on upper shuttle 16 above upper sprocket 76 also assist in guiding the drive chain 74 and in preventing premature escape of arms 146.

A guide rod handle 150 is carried at the upper end of guide rod 142. This handle includes a flared lower face 152 which would stop the upward travel of hammer 140, if necessary. In normal usage hammer 140 does not contact handle 150. A compaction foot 154 is attached to the lower end of guide rod 142. A sample of asphaltic or bituminous material under test, generally indicated at 156, is placed within a receptacle, again generally schematically indicated at 158, and compaction foot 154 is placed on top of the sample. The sample is compacted by the impact of the falling slide hammer 140 along guide rod 142 against compaction foot 154.

As was discussed previously, prior testing devices have relied on complex release mechanisms carried by the guide rod to release the slide weight from the chain drive. This was necessary because the release point had to change as the sample became compacted since the guide rod moved downwardly with respect to the drive chain during sample compaction. These complex release mechanisms also did not provide true free fall for the weight since its upward travel was stopped abruptly. In contrast with the prior devices, the automatic compactor in accordance with the present invention requires no complex release mechanisms since the release point of the weight with respect to the guide rod remains constant during sample compaction. A discussion of an operational sequence of the automatic compactor in accordance with the present invention will facilitate an understanding of this aspect of the invention.

Compaction mold 158 with specimen 156 is placed and secured by conventional means on bed 58. The foot 154 of tamping assembly generally 10 is placed in the mold and is secured vertically by lifting and lowering the shuttles generally 16, 18 by handles 125 to engage guide rod handle 150 into cup socket 116 which is attached to the horizontal overarm 110 of upper shuttle 16. As described above, the shuttles, supported by guide rod 142, move downwardly during compaction of the speciman 156 thus preserving a constant height-of-drop.

Drive motor 42, which may be a conventional electric motor, is turned on, and drives chain 74 in a clockwise direction about its triangular path. Pickup lugs 84 carried on chain 74 contact the undersurfaces of arms 146 and raise slide hammer 140 on guide rod 142. The weight 140 is released when the pickup lugs 84 change direction and pass rearwardly about upper driven sprocket 76. The slide weight 140 continues to travel upwardly along guide rod 142 until it decelerates to a rest point just below the lower face 152 of the guide rod handle 150. Weight 140 then falls downwardly until it strikes compaction foot 154. This collision causes slide hammer 140 to rebound upwardly along guide rod 142. The speed of drive chain 74 is controlled so that the pickup lugs 84 will have traveled their triangular path and will engage the undersurfaces of the arms 146 on weight 140 while it is still travelling upwardly after striking compaction foot 154. This reduces wear on the machine.

As the sample 156 is compacted, the compaction foot 154 and the guide rod 142 move down with it. Upper shuttle 16 is supported by the handle 150 of guide rod 142 through horizontal overarm 110, and it also moves downwardly. Similarly, since lower shuttle 18 is spring biased apart from upper shuttle 16 by spring 126 but is limited by travel away from upper shuttle 16 by chain 74, it also moves down. The net effect is that the distance between upper driven sprocket 76 and hence the release point of slide hammer 140 from drive chain 74 and handle 150 on guide rod 142 stays constant during sample compaction. As seen in the dashed lines in FIG. 1, the upper and lower shuttles, 16 and 18 respectively fall the same distance that the sample is compacted. Tension on the drive chain 74 is maintained constant by the spring 126 which is pre-set at the time of manufacture. Spring 126 also compensates for increasing chain length caused by chain wear. After compaction, the tamping shaft assembly is removed and stored in heating means until required for the next compaction cycle. The mold assembly is removed and the specimen extracted for testing.

The speed of operation of the automatic compactor, at approximately 80 impacts each minute, is dictated by Newton's Laws for falling bodies and the 18 inch drop height dictated by test procedures. A specific amount of time is required for the slide hammer to free fall 18 inches. The drive speed of the chain is calculated so that the pickup lugs will travel from their release point at the upper sprocket 76 to their pickup point so that they can engage the pickup arms 146 on weight 140 while it is still moving upwardly after striking compaction foot 154. The distance between upper driven sprocket 76 and guide rod handle 150 can then be calculated knowning the upward velocity imparted to weight 140 by driven chain 74. This distance is selected to allow a slight space between the upper point of travel of weight 140 and the under surface 152 of handle 150. This distance is then used to position horizontal overarm 110 with respect to upper sprocket 76 during construction of upper shuttle 16. Minor adjustments to this distance, which may be necessary if the speed of the drive motor 42 changes, can be made by using threaded adjusting rod 112. So long as the velocity of the drive chain 74 is kept constant, the height of throw of sliding hammer 140 above its release point will stay constant and an 18 inch fee fall drop, as dictated by ASTM standards, will be maintained. Any slippage of drive belt 60 can be remedied by the addition of supplemental weights 72 to platform 44. Thus the automatic compactor in accordance with the present invention provides a free falling weight and a constant drop height with an apparatus that requires no complex release mechanisms and is simple in construction yet durable enough to withstand the repeated impacts to which it is continually subjected.

While a preferred embodiment of an automatic compaction assembly for asphaltic and bituminous samples in accordance with the present invention has been fully and completely set forth hereinabove, it will be obvious to one of skill in the art that a number of changes in, for example, the type of drive motor and drive belts, the support means for the chain sprocket shafts, the shape of the slide hammer and the slide could be made without departing from the spirit and scope of the invention which is accordingly to be limited only by the following claims.

I claim:

1. An automatic compactor for compacting samples of material to be tested, said automatic compactor comprising:

a slide hammer slideable vertically along a guide rod, said guide rod being attached at a first, lower end to a compaction foot positionable on the sample to be compacted and extending generally vertically upwardly to a handle carried at a second, upper end of said guide rod;

a drive chain having a portion thereof generally parallel to said guide rod and having means to engage and raise said slide hammer along said guide rod;

a main frame assembly carrying a drive means for said drive chain;

means to release said slide hammer from said drive chain at a release point while allowing said slide hammer to continue to move vertically upwardly along said guide rod substantially without restriction until it decelerates and stops at a rest point above said release point and below said handle; and shuttle means interconnected with said handle for maintaining a constant vertical distance between said rest point and said compaction food during compaction of the sample, said shuttle means including means for lowering the portion of said drive chain which travels generally parallel to said guide rod with respect to said main frame to lower said release point and said rest point concurrently with downward travel of said guide rod during compaction of the sample.

2. The automatic compactor in accordance with claim 1 wherein said slide hammer includes drive chain engaging arms and further wherein said drive chain includes at least one set of pickup lugs which engage said arms.

3. The automatic compactor of claim 1 wherein a path for said drive chain is defined by an interconnected upper chain sprocket shuttle and a lower chain sprocket shuttle and a drive sprocket.

4. The automatic compactor of claim 3 wherein said interconnected upper shuttle and lower shuttle are vertically slideable in said main frame assembly.

5. The automatic compactor of claim 3 wherein said upper shuttle and said lower shuttle are spring biased apart.

6. The automatic compactor of claim 3 wherein said upper shuttle further includes a horizontal overarm.

7. The automatic compactor of claim 6 wherein said horizontal overarm includes a cup socket that receives said handle carried at said upper end of said guide rod.

8. The automatic compactor of claim 3 wherein said slide hammer is released from said drive chain by passage of said chain over an upper chain sprocket carried on said upper shuttle.

9. The automatic compactor of claim 8 wherein said upper chain sprocket moves downwardly with said compactor foot as the sample is compacted.

10. The automatic compactor of claim 1 wherein a drive motor is carried by a motor support plate pivotably carried by said main frame.

11. The automatic compactor of claim 10 wherein a drive belt driven by said drive motor drives said drive sprocket.

12. The automatic compactor of claim 11 wherein said drive belt is tensioned by the weight of said drive motor.

13. The automatic compactor of claim 12 including means to increase said belt tension by the addition of weight to said motor support plate.

14. The automatic compactor of claim 5 wherein a spring for spring biasing said upper shuttle and said lower shuttle apart is supported intermediate said upper shuttle and said lower shuttle between upper and lower horizontal platforms.

* * * * *